US007460090B2

(12) United States Patent
Kota et al.

(10) Patent No.: US 7,460,090 B2
(45) Date of Patent: Dec. 2, 2008

(54) IMAGE DISPLAY DEVICE AND DRIVE METHOD THEREOF

(75) Inventors: Atsushi Kota, Tokyo (JP); Yuji Kondo, Tokyo (JP); Shingo Kawashima, Tokyo (JP); Eitaro Nishigaki, Tokyo (JP)

(73) Assignee: Samsung SDI Co., Ltd., Suwon (KR)

( * ) Notice: Subject to any disclaimer, the term of this patent is extended or adjusted under 35 U.S.C. 154(b) by 717 days.

(21) Appl. No.: 09/808,040

(22) Filed: Mar. 15, 2001

(65) Prior Publication Data

US 2001/0050662 A1 Dec. 13, 2001

(30) Foreign Application Priority Data

Mar. 17, 2000 (JP) ..... 2000-076903

(51) Int. Cl.
*G09G 3/30* (2006.01)

(52) U.S. Cl. ..... 345/76; 345/77

(58) Field of Classification Search ..... 345/76–84, 345/207, 204, 210, 95, 91, 92, 75.2, 103, 345/690, 211; 315/345, 76, 77, 81, 169.3, 315/504, 507

See application file for complete search history.

(56) References Cited

U.S. PATENT DOCUMENTS

| | | | | |
|---|---|---|---|---|
| 4,935,670 | A | 6/1990 | Watanabe | |
| 5,032,832 | A | 7/1991 | Clerc et al. | |
| 5,726,677 | A * | 3/1998 | Imamura | 345/99 |
| 5,754,160 | A | 5/1998 | Shimizu et al. | |
| 5,874,933 | A | 2/1999 | Hirai et al. | |
| 5,923,309 | A | 7/1999 | Ishizuka et al. | |
| 6,288,496 | B1 * | 9/2001 | Suzuki et al. | 315/169.3 |
| 6,366,026 | B1 * | 4/2002 | Saito et al. | 315/169.3 |
| 6,414,661 | B1 * | 7/2002 | Shen et al. | 345/82 |
| 6,552,703 | B1 * | 4/2003 | Ushigusa | 345/77 |

FOREIGN PATENT DOCUMENTS

| | | |
|---|---|---|
| EP | 0784305 | 2/2004 |
| JP | 55-59492 | 5/1980 |

(Continued)

*Primary Examiner*—Duc Q. Dinh
(74) *Attorney, Agent, or Firm*—H.C. Park & Associates, PLC

(57) ABSTRACT

The object of present invention is to provide a image display device with a simple constitution and a method for driving the image display device. The image display device of the present invention comprises a plurality of stripe-like data electrodes, a light emitting layer, and a plurality of stripe-like scanning electrode formed on a substrate in sequence, and further comprises a image display portion formed by a plurality of light emitting elements in a matrix form at crossing points between said data electrodes and said scanning electrodes, and a column driving circuit and a row driving circuit for driving said image display portion by selecting and lighting the light emitting elements: wherein the row driving circuit has a function to simultaneously drive more than two of said scanning electrodes and successively lighting the horizontal regions in sequence corresponding to the number of scanning electrodes for simultaneously driving said light emitting elements; and the column driving circuit has a function to control a current flowing in said data electrodes such that a current density of said light emitting element is maintained at constant.

4 Claims, 10 Drawing Sheets

FOREIGN PATENT DOCUMENTS

| | | | |
|---|---|---|---|
| JP | 64-82097 | A | 3/1989 |
| JP | 4-46318 | A | 2/1992 |
| JP | 06-067621 | | 3/1994 |
| JP | 09-305146 | | 11/1997 |
| JP | 10-117316 | | 5/1998 |
| JP | 11-327506 | A | 11/1999 |
| JP | 2000-029432 | | 1/2000 |
| KR | 20000060831 | | 10/2000 |

* cited by examiner

IMAGE DISPLAY DEVICE AND DRIVE METHOD THEREOF

BACKGROUND OF THE INVENTION

1. Field of the Invention

The present invention relates to a type of image display device and a driving method thereof, and particularly relates to the image display device and drive method thereof which is capable of adjusting brightness by use of a simple circuit structure and by a simple operation.

2. Background Art

Recently, the demand for display devices has increased notably, and particular attention is being paid to flat displays represented by liquid crystal displays (LCD) and plasma displays (PD).

In particular, light emitting type display devices such as electro-luminescence display devices are advantageous in high visibility, wide angle of visibility, and they have the feature that they do not need the back light required for the LCD devices. Display devices using organic electro-luminescent (EL) elements are attracting attention as flat display devices with high response characteristics.

There are two driving systems for driving the dot matrix display devices having organic EL elements, in which one is a simple matrix system and the other is an active matrix system.

FIG. 10 is a block diagram showing an organic EL display using organic EL elements. This organic EL device is constituted by a color organic EL display 101 in a QVGA class using NTSC signals, a column driving circuit 102 for driving the column side of the display, and a row driving circuit 103 for driving the row side of the display.

This color organic EL display panel 101 has a matrix structure in which a plurality of lines of transparent anode electrodes (data electrodes), an organic EL thin film, and a plurality of lines of transparent cathode electrodes (scanning electrodes) are sequentially formed on a transparent plate such as a glass plate such that the anode electrode lines and the cathode electrode lines cross at a right angle to each other.

FIG. 11 is a timing chart showing the operational timing of a color organic EL display device. This display device is driven by a single scan drive method and comprises 240 lines of cathode electrodes (scanning electrodes) and 320×3 (RGB)=960 lines of anode electrodes (data electrodes).

The duty factor of this color organic EL display device becomes 1/240, since the cathode electrodes of this color organic EL display device are sequentially driven by the row driving circuit 103 (the scanning electrode), and since each of the 240 scanning electrode lines Y1 to Y240 are scanned in sequence to form a single image plane. In this driving device, one scanning line is always used for scanning at one time, so that this drive method is called a single scanning drive system.

In contrast to this single scanning drive system, there is another driving system called a double scanning drive system.

This double scanning drive system is a drive method in which two scanning electrode lines at the row side are always scanned in order to increase the brightness of the display. In the case of a QVGA class color organic EL display, horizontal scanning electrode lines are divided into two upper and lower groups (each group has 120 lines) by a horizontal location and two scanning electrode lines out of each group are driven by the single scanning drive system to form a single image so as to change the duty factor to 1/120. This double scanning drive system is disclosed, for example, in Japanese Unexamined Patent Application, First Publication No. Sho 61-264876.

However, the problem arises in the above-described conventional simple matrix system that the brightness of the organic EL device is reduced as the number of scanning electrode lines is increased and as the duty factor is reduced since the light emitting time is reduced in the above cases.

The brightness of the organic EL element is proportional to a current density applied to an emitting pixel. Thus, one of the measures to increase the brightness of the organic EL element is to increase the current density by increasing the voltage applied to the organic EL element.

However, the problem arises that application of a high voltage to the organic EL element reduces its service life. In addition, it becomes necessary to provide a circuit for regulating the voltage for every scanning electrodes or for every data electrode and another problem arises in that the constitution and control of the circuit becomes complicated, which results in increasing the cost of such a product.

In the case of, for example, the single scan drive system, the brightness of the organic EL display device is reduced, since the duty factor is reduced as the number of scanning electrodes increases because each light emitting element is turned on one by one by driving each scanning electrode. In the case of, for example, a QVGA class organic EL display, the number of scanning electrodes is 240, and the duty factor is 1/240, and the maximum brightness of the display is 70 cd/m$^2$, which is insufficient brightness for a practical display device.

The brightness of a color EL display can be improved in the case of the above-described double scan drive system. However, it becomes necessary for the organic EL display device to provide a memory device at the column side and the RGB signal fine adjustment circuit for according amplification levels of RGB signals becomes complicated, which results in increasing the cost of the product.

SUMMARY OF THE INVENTION

The present invention was carried out for solving the above problems and the object of the present invention is to provide an image display device and a driving method thereof, capable of adjusting the brightness by use of a simple circuit structure and a simple operational method.

According to the first aspect, the present invention provides an image display device which comprises a plurality of stripe-like data electrodes, a light emitting layer, and a plurality of stripe-like scanning electrodes formed on a substrate in sequence, and further comprises an image display portion formed by a plurality of light emitting elements in a matrix form at crossing points between said data electrodes and said scanning electrodes, and a column driving circuit and a row driving circuit for driving said image display portion by selecting and lighting said light emitting elements: wherein said row driving circuit has a function to simultaneously drive more than two of said scanning electrodes and successively lighting the horizontal regions in sequence corresponding to the number of scanning electrodes for simultaneously driving said light emitting elements, and said column driving circuit has a function to control a current flowing in said data electrodes such that a current density of said light emitting element is maintained without changing.

According to the second aspect, in the image display device according to the first aspect said image display portion is divided into a plurality of image display portions for displaying images by at least two image display regions by dividing said plurality of scanning electrodes to at least two regions.

According to the third aspect, in the image display device according to the second aspect, the second electrode is provided next to the last scanning electrode in said plurality of scanning electrodes such that the last scanning electrode makes the corresponding pixels emit sufficiently bright light.

According to the fourth aspect, in the image display device according to the third aspect, said light emitting element is selected from the group consisting of an EL element, a light emitting diode, or a FED.

The fifth aspect provides a method for driving an image display device which comprises a plurality of stripe-like data electrodes, a light emitting layer, and a plurality of stripe-like scanning electrodes formed on a substrate in sequence, and further comprises an image display portion formed by a plurality of light emitting elements in a matrix form at crossing points between said data electrodes and said scanning electrodes, and a column driving circuit and a row driving circuit for driving said image display portion by selecting and lighting said light emitting elements: wherein the method comprises the steps of driving simultaneously more than two of said scanning electrodes adjacent to each other, and lighting successively said light emitting elements in a horizontal region corresponding to the number of said scanning electrodes for driving said light emitting elements simultaneously, and controlling the current flowing in said data electrodes such that the current density in said light emitting element does not change.

DETAILED DESCRIPTION OF THE INVENTION

Hereinafter, image display devices and the driving methods of respective embodiments of the present invention are described with reference to the attached drawings.

First Embodiment

Figure 1:
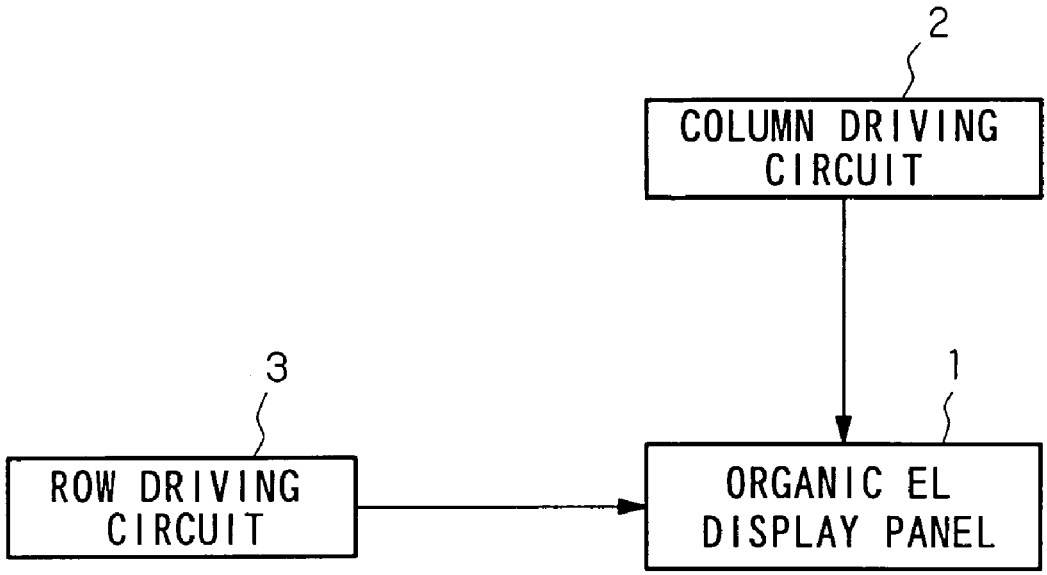
FIG. 1 is a block diagram showing a QVGA class color organic EL device driven by a single scan driving system according to the first embodiment of the present invention.

FIG. 1 is a block diagram showing a QVGA class color organic EL device (image display device) driven by a single scan driving system according to the first embodiment of the present invention, and the organic EL display panel (image display device) 1 comprises a column driving circuit 2 for driving the column side of the organic EL display device and a row driving circuit 3 for driving the row side of the organic EL display device.

Figure 2:
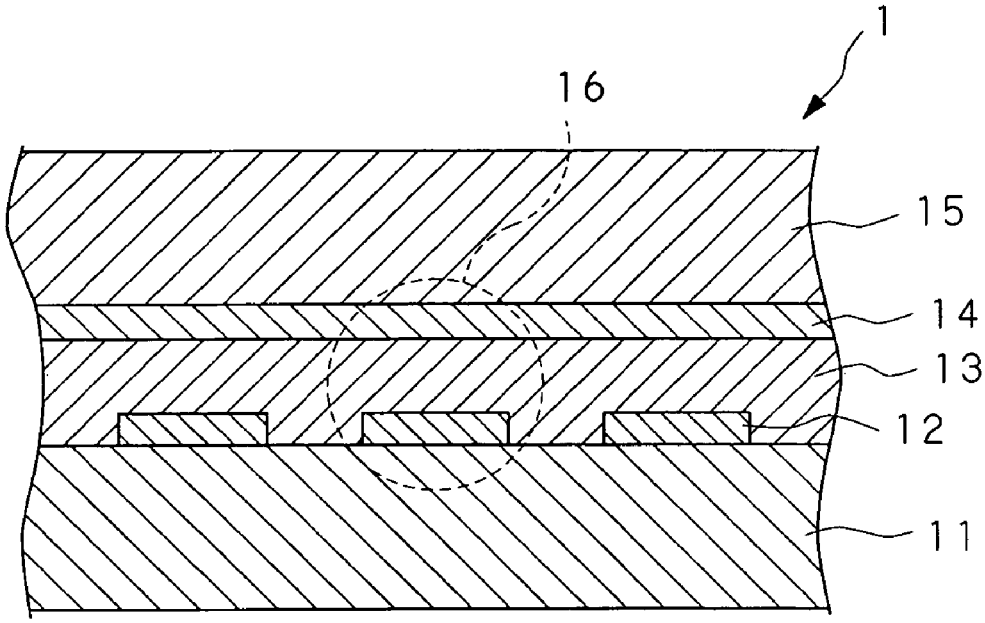
FIG. 2 is a cross-sectional view of the organic EL display panel according to the first embodiment of the present invention.

As shown in FIG. 2, this organic EL display panel 1 is provided sequentially with a cathode (data electrode) 12 formed by a plurality of stripe-shaped transparent electrodes, an organic EL thin film (light emitting layer) 13, and an anode (scanning electrode) 14 formed by a plurality of stripe-shaped metal electrodes, which are covered by a transparent substrate 15 such as a glass plate and the cathode (data electrode) 12 and anode (scanning electrode) 14 form a matrix structure by crossing to each other. Organic EL pixels (organic EL element) 16 are formed in a matrix arrangement at respective cross points of the cathode (data electrode) 12 and the anode (scanning electrode) 14.

The column driving circuit 2 drives the column side of the organic EL device by a given control data, and, after converting the control signal by a given signal voltage level to a signal having a predetermined current value, an image is displayed by applying a current having a predetermined current density to each organic EL pixel 16 in the organic EL display panel 1.

The row driving circuit 3 drives the row side of the organic EL display panel by a given control data and displays the image. The driving method of the row side according to this embodiment is to switch the connection of the row side electrodes to the power supply, to the ground, or to the intermediate potential.

This row side driving circuit 3 drives the row side electrode by any one of the following methods of, connecting the row side electrode to the ground while driving the display device and switches the connection of the row side electrode to the power supply while not driving the display device, connecting the row side electrode to the power supply while driving the display device and switching the connection of the row side electrode to the ground while not driving the display device, connecting the row side electrode to the ground or to the power supply while driving the display device and switches the connection of the row side electrode to a certain intermediate potential while not driving the display device, or connecting the row side electrode to an intermediate potential while driving the display device and switching the connection of the row side electrode to the ground or the power supply while not driving the display device.

In the present invention, a method is adopted wherein the row side electrode is connected to the ground during driving the display panel and switch the connection of the row side electrode to the power supply while not driving the display panel.

Next, an explanation is provided about the operation of the organic EL display panel below.

As described above, in the color organic EL display device which comprises a pair of the anode (scanning electrode) 14 and the cathode (data electrode) 12 forming a matrix, and organic EL pixels 16 formed between the anode (scanning electrode) 14 and the cathode (data electrode) 12, a control signal is applied to the row driving circuit 3 for sequentially driving the anode (scanning electrode) 14 by driving the n-th and the (n−1)-th anodes of the organic EL display device simultaneously. At the same time, a control signal is applied to the column driving circuit 2 for applying a two times larger current to the cathode electrodes (data electrodes) 12 so as to maintain the current density of each organic EL pixel 16 constant.

Next, the operation of this color organic EL display is more concretely described.

Figure 3:
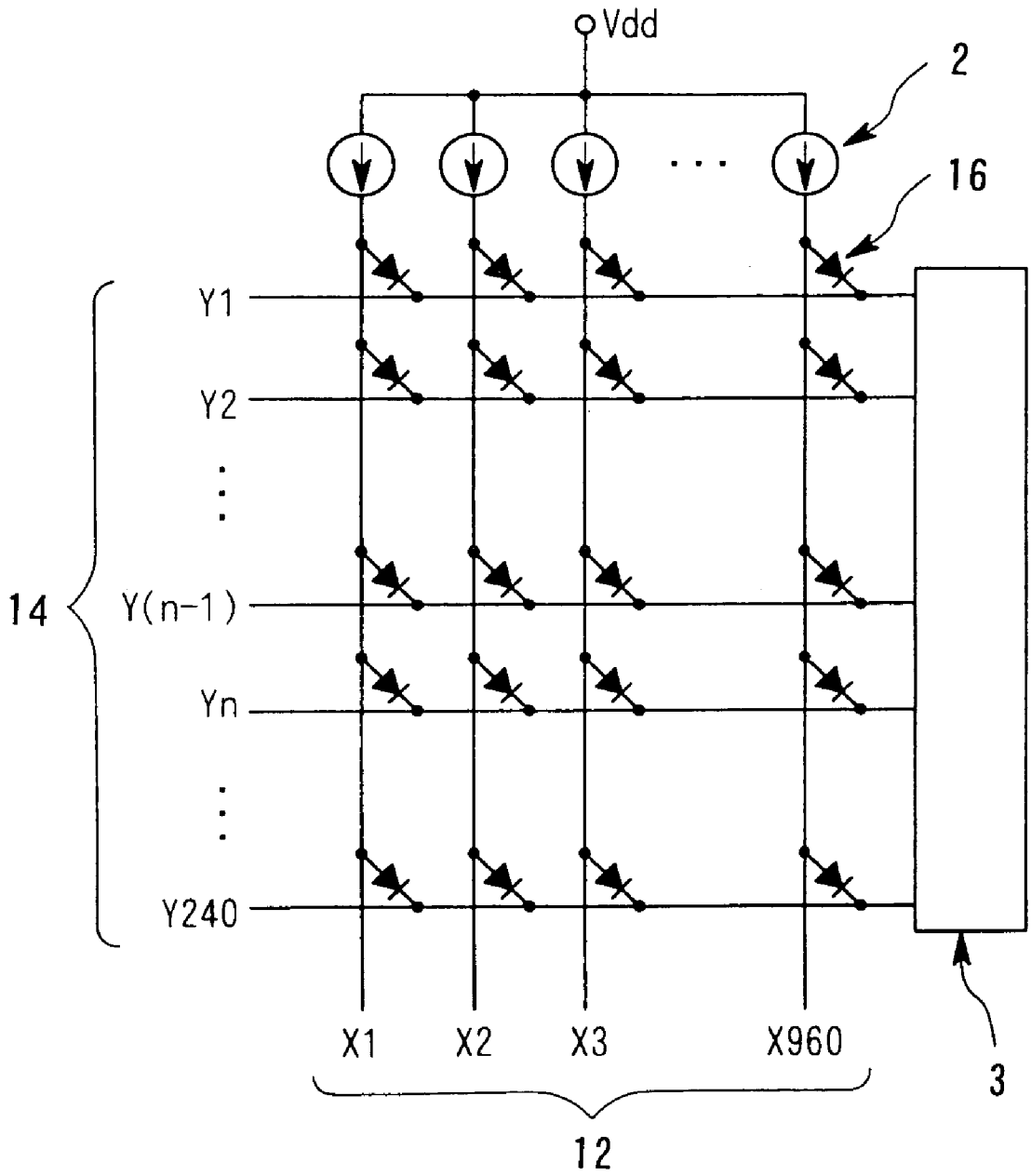
FIG. 3 is a matrix diagram showing the organic EL display panel according to the first embodiment of the present invention.

FIG. 3 shows a matrix representation of a QVGA class color organic EL device according to the present invention.

As shown in FIG. 3, the number of electrodes for the QVGA class display is 240 for the anode (scanning electrodes) 14, and 320×3 (RGB)=960 for the cathode (data electrodes) 12.

Furthermore, organic EL pixels are formed in a matrix form by being inserted between the anode 14 and cathode 12 and each cathode 12 electrode is connected to a column driving circuit 2 and each anode 14 electrode is connected to a row driving circuit 3.

In this color organic EL display, since the organic EL pixels 16 connected to a scanning electrode Y1 are lighted during times T1 to T3, and since the organic EL pixels 16 connected to the scanning electrode Y2 are lighted during times T2 to T4, the scanning electrodes Y1 and Y2 are driven simultaneously, so that organic EL pixels connected to these electrodes are lighted simultaneously.

Thus, although it will be deemed that the image extends in the upward direction and the resolution in the perpendicular direction decreases by one half, since the scanning electrodes are scanned in sequence one by one, the image does not extend in the upward direction and the resolution in the vertical direction does not fall by one half. When the data is one dot in the horizontal direction, although the horizontal line expands into two times and the resolution falls to one half, the resolution in the horizontal direction does not change. When the image is an image under natural light such as an animation, it was understood from the calculation in the data processing that the resolution of this image display system is reduced into 80% of the original resolution.

Figure 4:
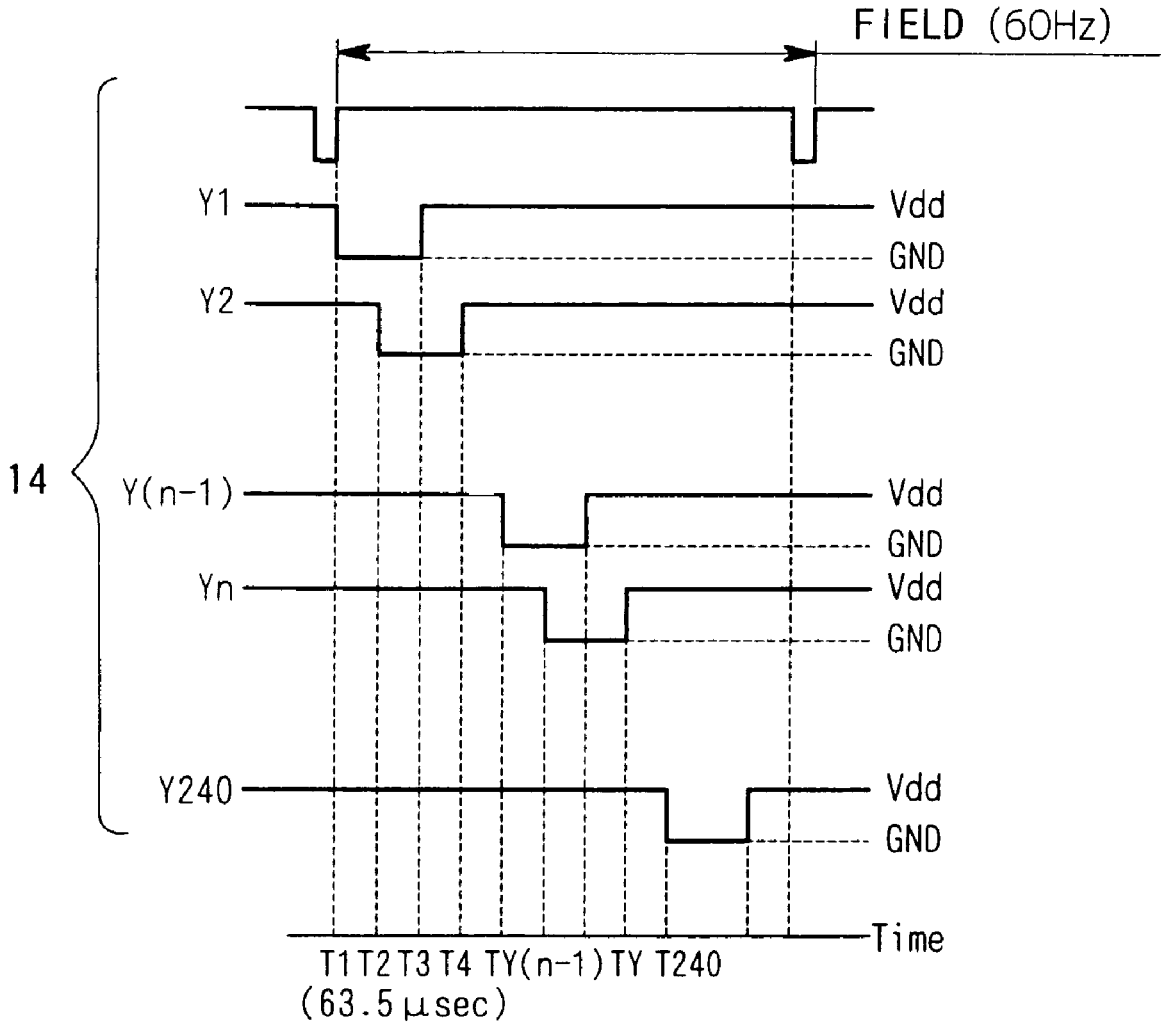
FIG. 4 is a timing chart showing the operation of the organic EL display panel according to the first embodiment of the present invention.

FIG. 4 is a timing chart showing the operation of the QVGA class color organic EL display, and this figure illustrates the case of simultaneously driving two anode electrodes (scanning electrodes) using the NTSC signals.

The NTSC signal is constituted by 60 Hz vertical synchronizing signals and a 15.75 kHz (63.5 μs) horizontal synchronizing period.

In the present color organic EL display, a control signal is given to the row driving circuit 3 for scanning the anode electrodes (scanning electrode) 14 by shifting from Y1, Y2, Y3 . . . in sequence every 63.5 μs as usual, while the driving period is set at 127 μs, which is twice as long as the usual period. At the same time, a control signal is given to the column driving circuit for driving the organic EL pixels without making any change to the current density applied to the organic EL pixels by applying a current two times larger than the original current to the cathode 12.

Figure 5:
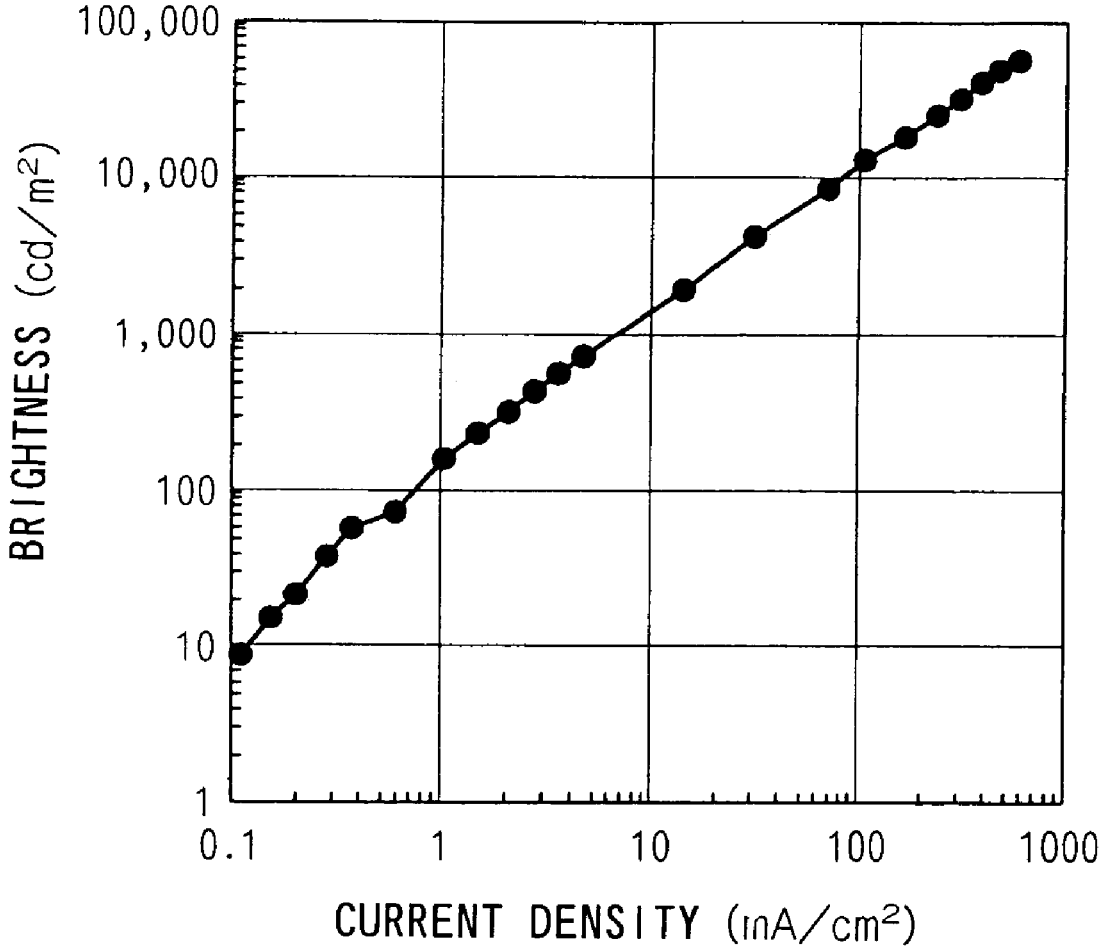
FIG. 5 is a diagram showing the relationship between the current density and brightness of an organic EL pixel.

FIG. 5 shows the relationship between the current density applied to the organic EL pixels and the pixel brightness. In the present organic EL pixel, a linear relationship is observed between the current density and the brightness. Accordingly, it is necessary to maintain the current density applied to the organic EL pixel constant in order to maintain a constant brightness of the display panel.

In the present embodiment, in the case of driving two electrodes at the same time, if the current from the column is maintained as usual, the current flowing in the organic EL pixel is reduced by a half and the brightness is also reduced by a half. In order to prevent the reduction of the brightness at the time when two anode electrodes (scanning electrodes) 14 are driven simultaneously, the current from the column must be doubled so that the current density to the organic EL pixels is maintained unchanged.

As described above, with the color organic EL display according to the present embodiment, it is easily possible to change the duty factor from 1/120 to 1/80 by scanning the anode (scanning) electrodes 14 one by one in sequence and by simultaneously driving two anode (scanning) electrodes. Furthermore, it is also possible to increase the brightness of the display two or three times so that the brightness of the color organic EL display can be improved beyond the practically required level.

In addition, the lighting brightness of the organic EL display panel can be regulated easily by changing the respective control data for the row driving circuit 3 and the column driving circuit 2.

Furthermore, the present driving system differs from the double scan driving system by the upper and lower division, and it is not necessary in this system to store the data control signal temporarily in the memory, so that the circuit can be constituted by a simple structure with no memory device.

In addition, since only one amplification circuit is required for processing the RGB signals, the RGB signal fine adjustment circuit of the present display can be simplified. Accordingly, the cost of the display device can be reduced.

The number of anode (scanning) electrodes 14 can be easily changed by a simple control data, and it is possible to control the brightness of the display by a simple operation.

As described above, the simple circuit constitution of the present embodiment without adding any particular circuit makes it possible to provide a color organic EL display and a driving method thereof, capable of adjusting the brightness by a simple operation and eliminating flickering of the display screen.

In addition, since a complicated control of the RGB signals is not necessary in the present embodiment, the present color organic EL display can be provided by a simple circuit constitution and at a reduced cost.

Second Embodiment

Figure 6:
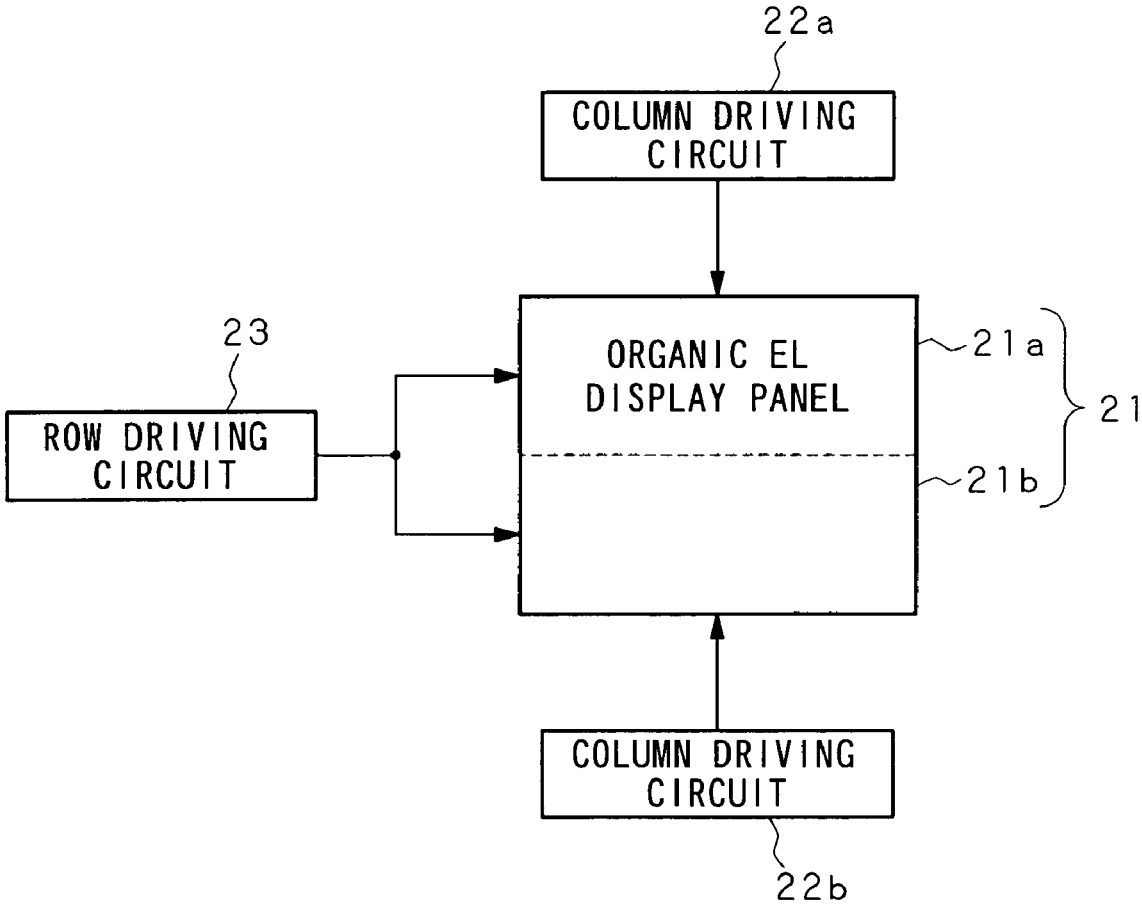
FIG. 6 is a block diagram showing a QVGA class color organic EL device driven by a single scan driving system according to the second embodiment of the present invention.

FIG. 6 is a block diagram showing a QVGA class color organic EL display (image display) in the double scan driving system according to the second embodiment of the present invention. This color organic display device comprises an organic EL display panel 21 (image display device) driven by the double scan driving system for displaying two images 21*a* and 21*b* obtained by dividing the original image into the upper and lower images 21*a* and 21*b*, column driving circuits 22*a* and 22*b* for driving the column side electrodes of two images 21*a* and 21*b* formed by dividing an image into two upper and lower images, and a row driving circuit 23 for supplying signals at the same time for two divided images 21*a* and 22*b*.

The present organic EL display panel 21 should be provided with two column driving circuits for respective images 21*a* and 21*b*, since this display panel 21 is driven by the double scan driving system which displays two images 21*a* and 21*b* divided vertically into two portions. In contrast, the present organic EL display panel 21 needs to be provided with one row driving circuit 23, since the row driving circuit 23 is required to supply the same timing signal to both divided images 21*a* and 21*b*.

Next, an explanation is provided for the color organic EL display according to the present embodiment with reference to the attached drawings.

Figure 7:
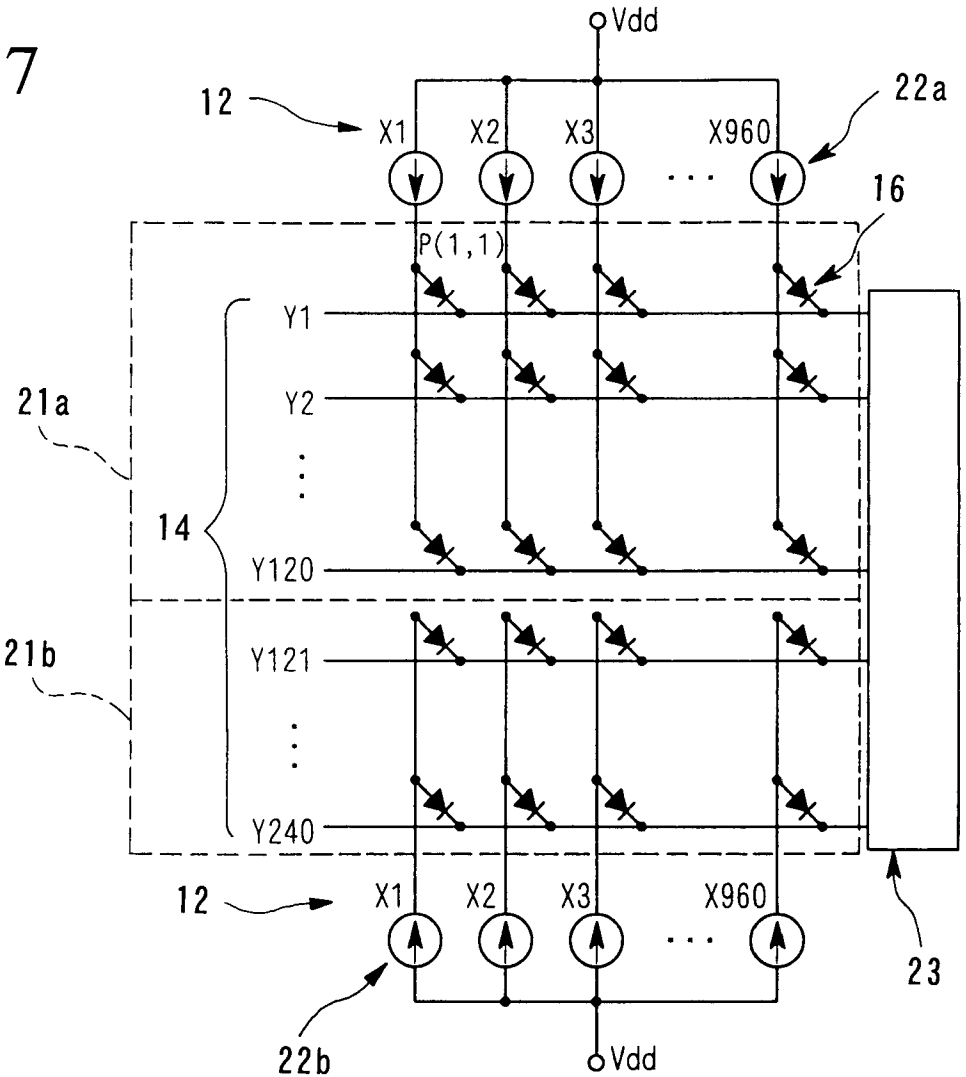
FIG. 7 is a matrix diagram showing a double scanning system of the organic EL display panel according to the second embodiment of the present invention.

FIG. 7 is a matrix diagram showing the operation of the QVGA class color organic EL display according to the second embodiment of the present invention.

As shown in FIG. 7, this color organic EL display is constituted so that the cathode electrodes (data electrodes) 12 are divided into two at the position between the 120-th and the 121-th anode electrodes (scanning electrodes), and an upper column driving circuit 22*a* is connected to the upper image 21*a* from the upper side and a lower column driving circuit 22*b* is connected to the lower image 21*b* from the column side of the lower image 21*b*.

Figure 8:
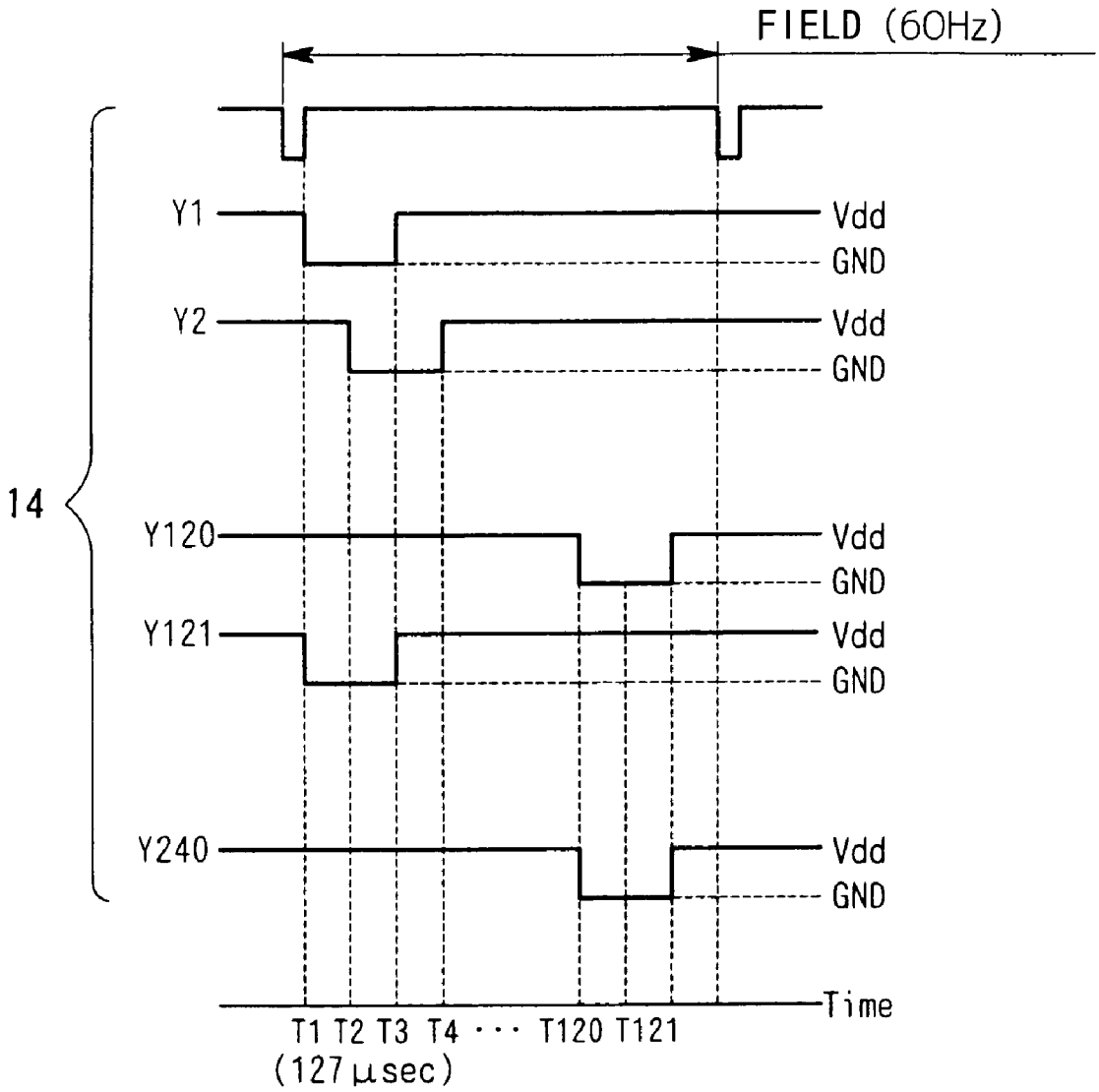
FIG. 8 is a timing chart showing operations of the organic EL display panel according to the second embodiment of the present invention.

FIG. 8 is a timing chart showing the operation of the QVGA class color organic EL display device. This color organic EL display is driven by the double scan driving system using the NTSC signals.

The scanning electrodes of this color organic EL display are shifted in the order of Y1, Y2, Y3 . . . every 127 μs as usual after a control signal is input to the row driving circuit 23 and after the driving period of the anode (scanning) electrodes 14 is set at 254 μs, which is two times longer than usual. In this scanning operation, the scanning electrodes Y1 to Y120 are driven at the same timing of the scanning electrodes Y121 to Y240. At the same time, the column driving circuits 22*a* and 22*b* receive a control signal for supplying a larger current, 2 times larger than usual, to the cathode; thereby the organic EL pixels 16 are driven without incurring a change in the current density.

Figure 9A:
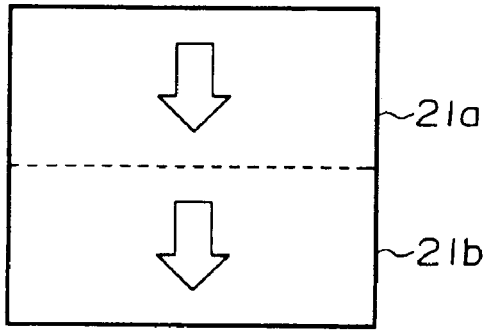
FIGS. 9A to 9D are schematic diagrams showing scanning directions of the scanning electrodes of the upper image and the lower image according to the second embodiment of the present invention.
Figure 9B:
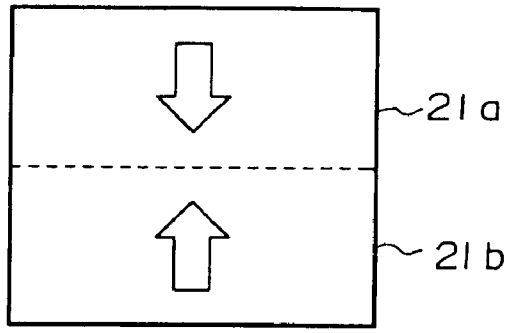
Figure 9C:
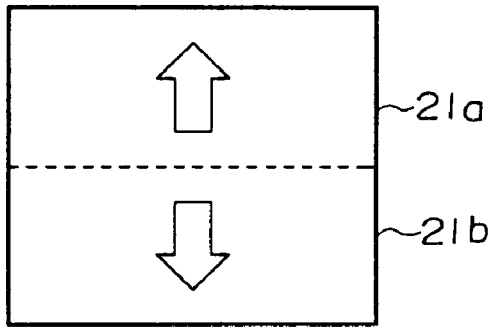
Figure 9D:
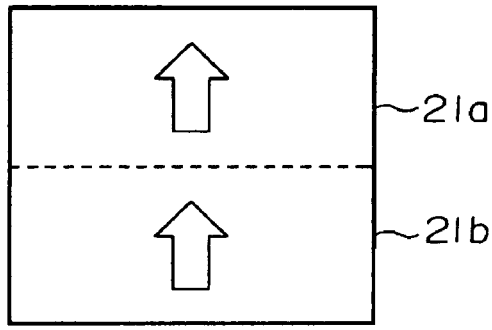
Figure 10:
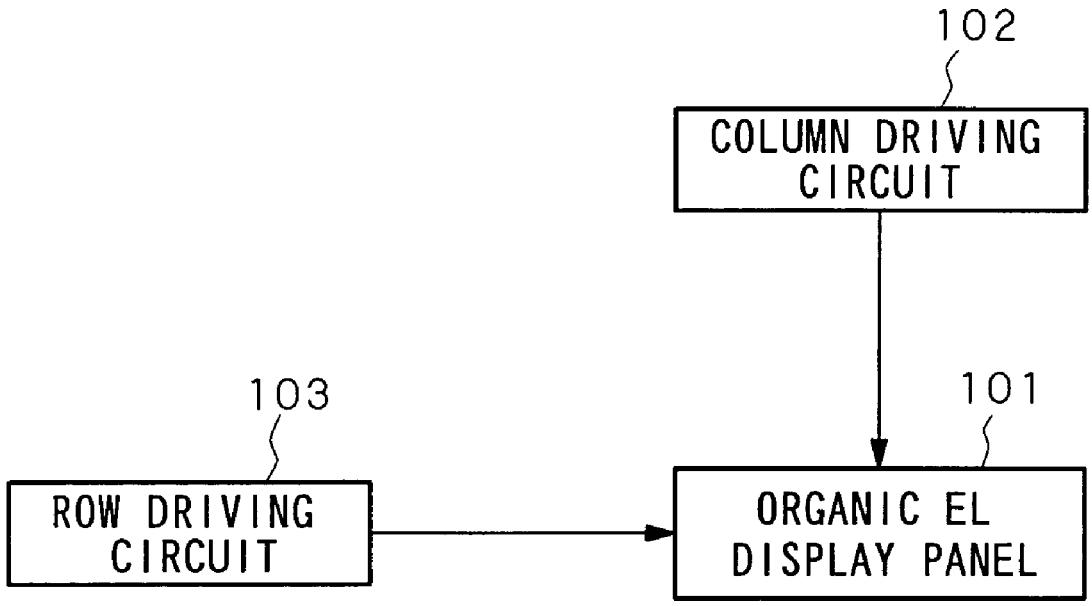
FIG. 10 is a block diagram showing a conventional color organic EL device of a simple matrix system.
Figure 11:
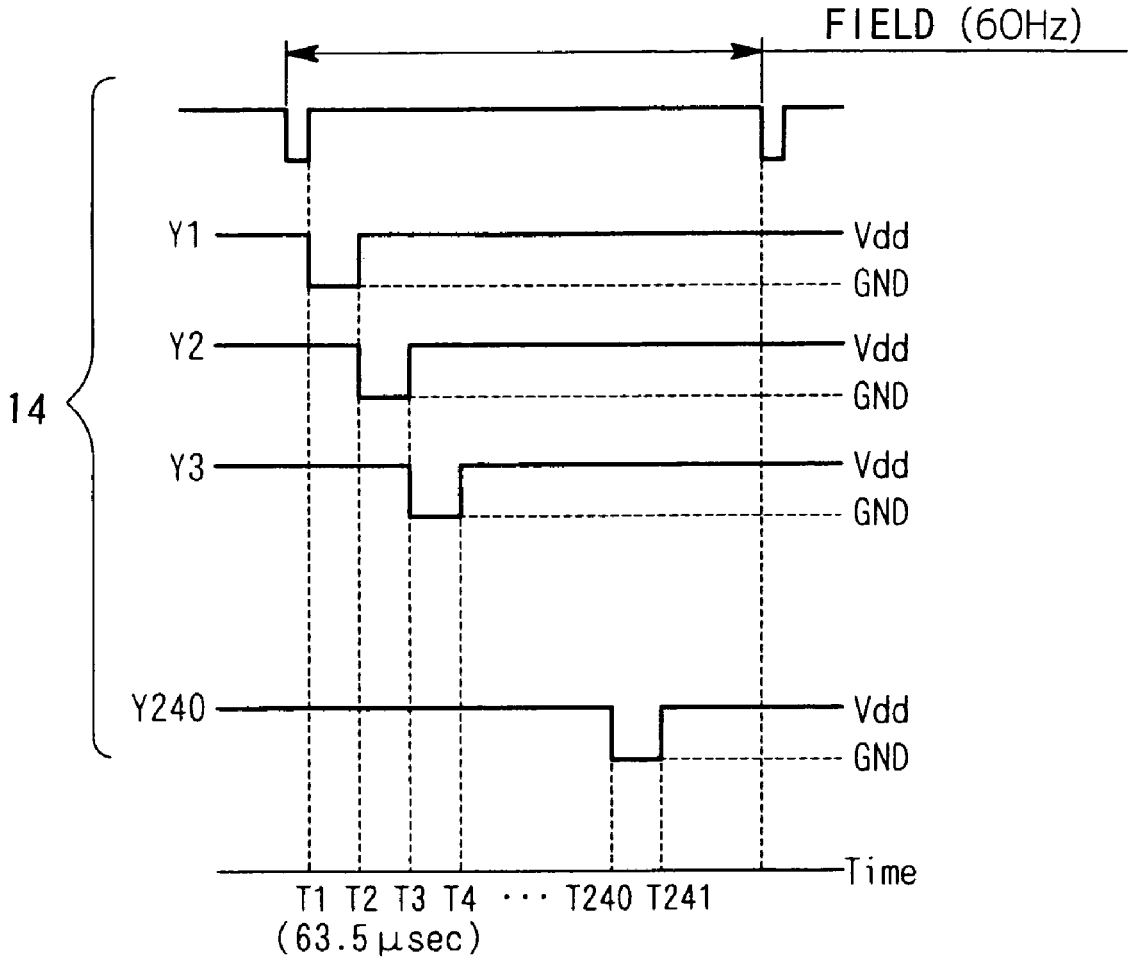
FIG. 11 is a timing chart showing operations of the conventional color organic EL display.

As shown in FIG. 9A. the upper image 21*a* and the lower image 21*b* are displayed at the same time by scanning both scanning electrodes from Y1 and Y121 to Y120 to Y240 at the same timing. However, the organic EL display device may be constituted for displaying the upper image 21*a* and the lower image 21*b* by scanning the scanning electrodes in any scanning direction such as scanning, as shown in FIG. 9B, from the respective ends Y1 and Y240 toward the center electrodes Y120 and Y121, scanning as shown in FIG. 9C, from both center electrodes Y120 and Y121 towards both ends Y1 and Y240, or scanning as shown in FIG. 9D, from respective bottoms Y120 and Y240 towards both top electrodes Y1 and Y121.

The duty factor of this color organic EL display device according to the present embodiment can be modified easily from 1/120 to 1/60(=2/120), so that the brightness of the display can be easily modified by a factor of two.

The resolution in the vertical direction can be retained within 80% of the original resolution.

In addition, the brightness of the present color organic EL display device can be adjusted easily by changing the control data of the row driving circuit 23 and the column driving circuits 22*a* and 22*b*.

As described above, the image display device and the driving method thereof are explained for two embodiments of the present invention. However, the concrete constitution of the present invention is not limited to those embodiments, and variants can be envisaged without exceeding the scope of the present invention.

For example, although organic EL elements are used as the light emitting elements in the above embodiments, inorganic EL elements, light emitting diodes, or FEDs can be adopted.

In addition, it is a matter of course that the number of scanning electrodes which are simultaneously scanned can be modified from two to three.

According to the present invention, at least two scanning electrodes adjacent to each other are activated and the light emitting elements are activated by scanning these two scanning electrodes simultaneously in an overlapping manner, so that the duty factor can be easily changed. Therefore, it is possible to increase the brightness of the display device so that the brightness of the display device reaches a level beyond that required for practical use.

A favorable feature of the present invention is that the brightness of the present image display device can be adjusted only by changing the control data of the row driving circuit and the column driving circuit.

Another favorable feature of the present invention is that, since the number of scanning electrodes for simultaneous driving can be modified easily by changing the control data, the brightness can be regulated easily by a simple circuit constitution and by a simple operation of the circuit.

With the above arrangements and operations, the present invention provides the image display device and the driving method thereof.

What is claimed is:

1. An electroluminescent (EL) image display device which comprises a plurality of stripe-like data electrodes, a light emitting layer, and a plurality of stripe-like scanning electrodes formed on a substrate in sequence, and further comprises an image display portion formed by a plurality of light emitting elements in a matrix form at crossing points between said data electrodes and said scanning electrodes, and a column driving circuit and a row driving circuit for driving said image display portion by selecting and lighting said light emitting elements: wherein, said row driving circuit simultaneously drives more than two of said scanning electrodes and successively lighting horizontal regions in sequence corresponding to the number of simultaneously driven scanning electrodes; and said column driving circuit controls a current flowing in said data electrodes such that the current through said data electrodes is proportional to the number of simultaneously driven scanning electrodes.

2. An image display device according to claim 1, wherein said image display portion is divided into a plurality of image display portions for displaying images by at least two image display regions by dividing said plurality of scanning electrodes into at least two regions.

3. An image display device according to claim 2, wherein said light emitting element is selected from the group consisting of a EL element, a light emitting diode, or an FED.

4. A method for driving an image display device which comprises a plurality of stripe-like data electrodes, a light emitting layer, and a plurality of stripe-like scanning electrodes formed on a substrate in sequence, and further comprises a image display portion formed by a plurality of light emitting elements in a matrix form at crossing points between said data electrodes and said scanning electrodes, and a column driving circuit and a row driving circuit for driving said image display portion by selecting and lighting said light emitting elements: wherein the method comprises the steps of:

driving simultaneously more than two of said scanning electrodes adjacent to each other for lighting said light emitting elements in a horizontal region corresponding to the number of simultaneously driven scanning electrodes; and controlling the current flowing in said data electrodes such that the current through said data electrodes is proportional to the number of simultaneously driven scanning electrodes.

* * * * *